US006155069A

United States Patent [19]

Quartarone et al.

[11] Patent Number: 6,155,069

[45] Date of Patent: Dec. 5, 2000

[54] COLD PLATE

[75] Inventors: Daniel S. Quartarone, Stone Mountain; Paul A. Phillips; Franchot Chang, both of Marietta, all of Ga.; Thaddeus M. Jablonski, Palatine, Ill.; Ryan D. Schuchart, Mason City; Michael S. Meyer, Clear Lake, both of Iowa; Richard L. Laughlin, San Antonio; William A. Edwards, La Vernia, both of Tex.

[73] Assignee: The Coca-Cola Company, Atlanta, Ga.

[21] Appl. No.: 09/387,221

[22] Filed: Aug. 31, 1999

[51] Int. Cl.[7] ..... F25C 5/18; B67D 5/56

[52] U.S. Cl. ..... 62/344; 222/129.1; 222/129.2; 222/129.3; 222/129.4

[58] Field of Search ..... 62/344, 400; 165/164; 222/146.6, 129.1, 129.2, 129.3, 129.4

[56] References Cited

U.S. PATENT DOCUMENTS

| | | | |
|---|---|---|---|
| 3,391,730 | 7/1968 | Calhoun, Jr. | 62/400 |
| 4,651,538 | 3/1987 | Bull et al. | 62/400 |
| 5,319,947 | 6/1994 | Fisher | 62/389 |
| 5,350,086 | 9/1994 | Martin et al. | 62/400 |
| 5,419,393 | 5/1995 | Guy, III | 165/168 |
| 5,484,015 | 1/1996 | Kyees | 165/168 |
| 5,487,492 | 1/1996 | Goulet | 222/129.1 |

*Primary Examiner*—William E. Tapolcal
*Assistant Examiner*—Mohammad M Ali
*Attorney, Agent, or Firm*—Sutherland Asbill & Brennan LLP

[57] ABSTRACT

An improved cold plate for use with a beverage dispenser. The beverage dispenser has an ice chest and a carbonator unit. The cold plate is positioned beneath the ice chest. The cold plate includes a first surface in direct contact with the ice chest. The cold plate further includes a second surface with a concave middle portion such that the carbonator unit is positioned directly therein for intimate contact therewith.

21 Claims, 5 Drawing Sheets

COLD PLATE

RELATED APPLICATIONS

The following patent applications for related subject matter,

"Modular Beverage Dispenser Components";

"Mounting Block For Syrup Pump And Accessories"; and

"Water Tank And Pump System";

all of which are incorporated herein by reference, have been filed concurrently with the present application by the assignee of the present application.

TECHNICAL FIELD

The present invention relates generally to a beverage dispenser and more particularly relates to a beverage dispenser having an improved cold plate for integral use with a carbonator unit.

BACKGROUND OF THE INVENTION

Cold plates have long been used with beverage dispensers to chill fluids flowing therethrough. Generally described, a cold plate is an aluminum casting-type structure with a series of sleeves and/or tubes positioned or molded therein for fluid flow. The cold plate is generally positioned within the beverage dispenser in direct physical contact with an ice chest. The cold plate is generally positioned at the bottom of the ice chest. Fluids such as plain water, soda water, and syrup travel through the sleeves or the tubes within the cold plate. Heat is exchanged from the fluids through the sleeves or the tubes and the aluminum casting of the cold plate with the ice within the ice chest. The fluids are therefore chilled to the appropriate temperature before being served from the beverage dispenser.

An example of a known cold plate design is found in commonly-owned U.S. Pat. No. 5,319,947, entitled "Beverage Dispenser." The disclosure of this patent is incorporate herein by reference. The cold plate described in this example chills the fluids flowing therethrough in a conventional manner. Further, the cold plate also has an exterior sleeve connected thereto that extends outwardly so as to chill a conventional carbonator unit positioned somewhat below the cold plate. The carbonator unit mixes the incoming tap water with carbon dioxide gas so as to produce soda water. The exterior sleeve cools the carbonator unit by conduction such that the water within the carbonator unit is also chilled as it flows therethrough.

Although the extended carbonator sleeve described above provides for conduction cooling, temperature differences still may exist between the water in the carbonator unit and the fluids running through the cold plate itself. The effectiveness of the conduction cooling apparently may diminish somewhat given the distance between the ice chest and the carbonator unit. The ability to cool the carbonator unit to the same or at least to a similar temperature as the cold plate would increase the cooling efficiency of the beverage dispenser as a whole. What is needed, therefore, is a means for efficiently cooling the carbonator unit when used with a cold plate.

SUMMARY OF THE INVENTION

The present invention thus provides an improved cold plate for use with a beverage dispenser. The beverage dispenser has an ice chest and a carbonator unit. The cold plate is positioned beneath the ice chest. The cold plate includes a first surface in direct contact with the ice chest. The cold plate further includes a second surface with a concave middle portion such that the carbonator unit is positioned directly therein for intimate contact therewith.

Specific embodiments of the present invention include the cold plate having a casting with a number of sleeves positioned therein. The casting may be aluminum and the sleeves may be stainless steel. The sleeves may be cooling coils in the form of conventional tubing or tubing with interior structures. The cold plate also may include a soda water inlet fitting, a soda water outlet fitting, a carbonator unit outlet fitting in communication with the carbonator, and a carbonator unit inlet fitting in communication with the carbonator.

A further embodiment of the present invention provides for the second surface of the cold plate having a raised central portion. The raised central portion includes the concave middle portion therein. The first surface includes a number of upper sleeves positioned adjacent thereto and the second surface includes one or more lower sleeves positioned equally on either side of the concave middle portion.

A further embodiment of the present invention provides for a beverage dispenser with an ice chest. The beverage dispenser includes a carbonator unit and a cold plate. The cold plate has a first surface in direct contact with the ice chest and a second surface with a concave middle portion. The carbonator unit is positioned within the concave middle portion for intimate contact therewith. The cold plate includes a carbonator unit outlet fitting and a carbonator unit outlet fitting. The carbonator unit includes a water inlet in communication with the carbonator unit outlet fitting and a soda water outlet in communication with the carbonator unit outlet fitting. The carbonator unit may be stainless steel. The carbonator unit is fixedly attached to the cold plate with approximately thirty (30) to fifty percent (50%) of the carbonator unit in contact with the cold plate. A water stream may receive about 4.5 to about 8.5 volumes of carbon dioxide gas when traveling through the carbonator unit.

Other objects, features, and advantages of the present invention will become apparent upon review of the following detailed description of the preferred embodiments of the present invention, when taken in conjunction with the drawings and the appended claims.

DETAILED DESCRIPTION OF THE INVENTION

Figure 1:
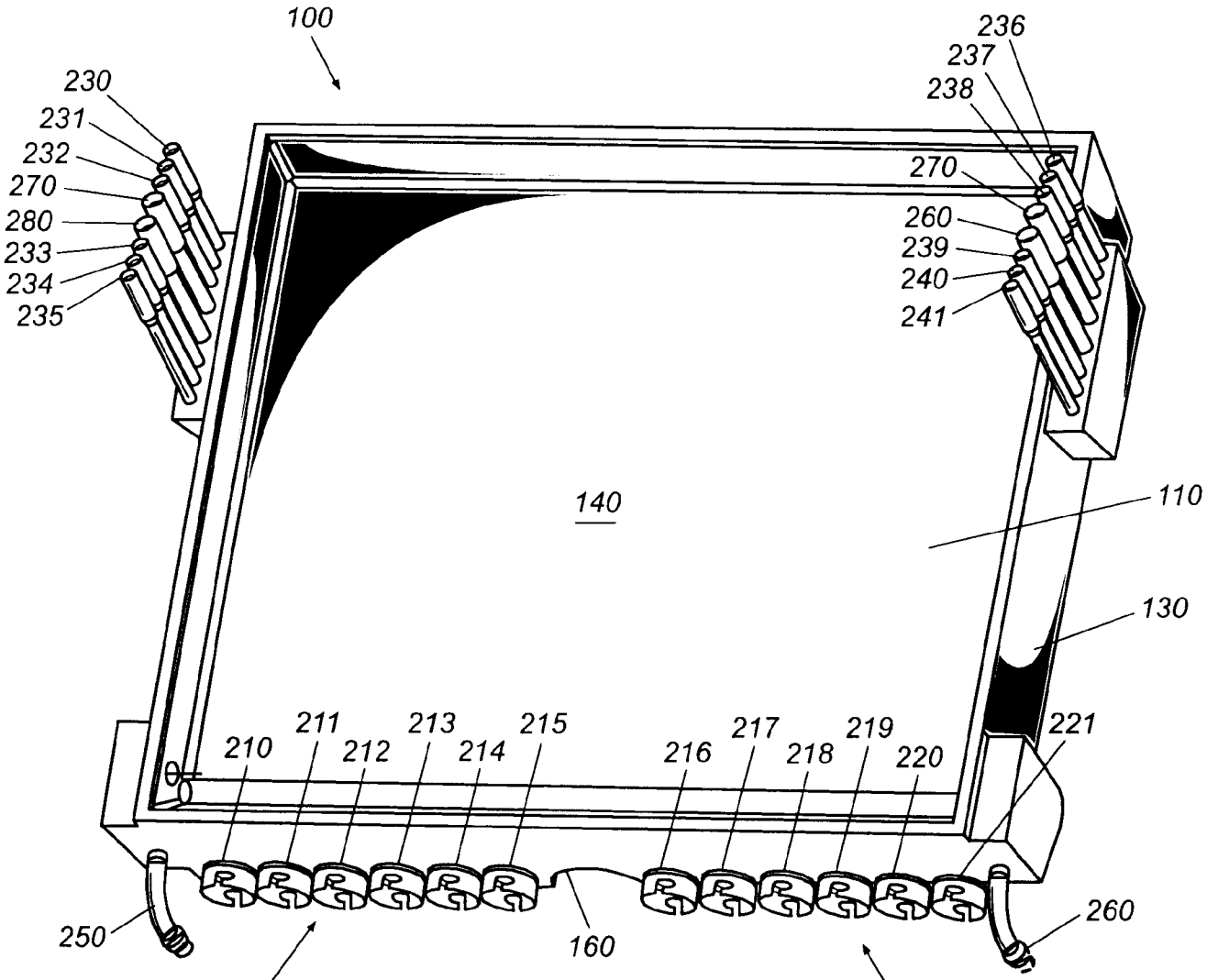
FIG. 1 is a perspective view of the cold plate of the present invention.
Figure 3:
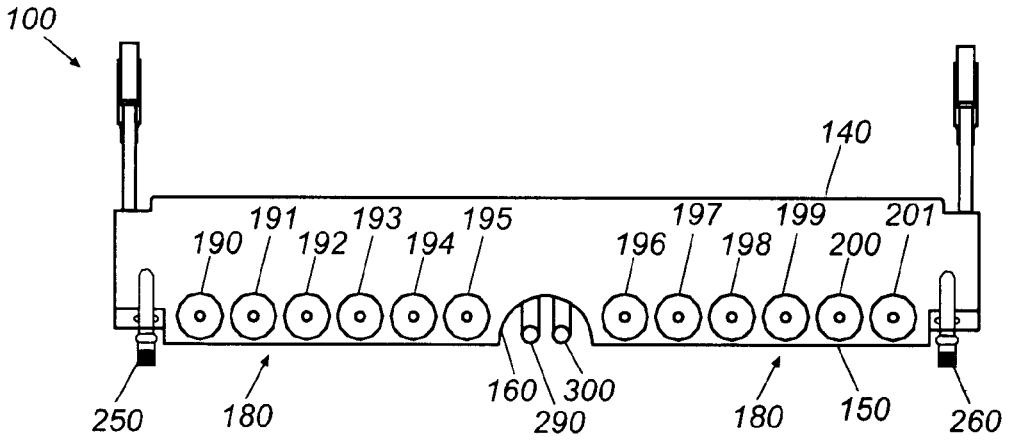
FIG. 3 is a side cross-sectional view of the cold plate of FIG. 2.

Referring now to the drawings, in which like numerals refer to like parts throughout the several views, FIG. 1 through FIG. 3 show a cold plate 100 of the present invention. The cold plate 100 may include a casting 110 with a series of sleeves 120 positioned therein. The casting 110 is preferably made from aluminum or a similar material with good heat transfer characteristics. The casting 110 is generally surround by a rigid frame 130.

The casting 110 of the cold plate 100 is essentially rectangular in shape. The casting 110 forms an upper surface 140 and a lower surface 150. The upper surface 140 is substantially flat. The ice of the ice chest generally rests directly upon the upper surface 140 of the casting 110 for heat transfer therewith. The lower surface 150 is also generally flat but with a concave middle portion 160. The concave middle portion 160 extends generally along the length of the casting 110. The concave middle portion 160 is adapted generally to the dimensions of a typical carbonator unit for direct physical contact therewith.

The sleeves 120 positioned within the casting 110 are generally made from stainless steel or similar types of substantially non-corrosive types of rigid materials. The shape, size, and/or pathway the sleeves 120 may take within the casting 110 are varied and known to those skilled in the art. For example, the sleeves 120 may be conventional "accordion"-shaped tubing or the sleeves 120 may accommodate an interior structure. In either case, the sleeves 120 may form a plurality of cooling coils 180. The cooling coils 180 may chill fluid such as syrup or water depending upon the intended use of the beverage dispenser as a whole. The design of the cooling coils 180 may be conventional and known to those skilled in the art. Alternatively, the design of the cooling coils 180 with an interior structure may be similar to that found in commonly-owned U.S. patent application entitled "Modular Beverage Dispenser Components", filed simultaneously herewith as described above. This patent application is incorporated herein by reference.

Figure 2:
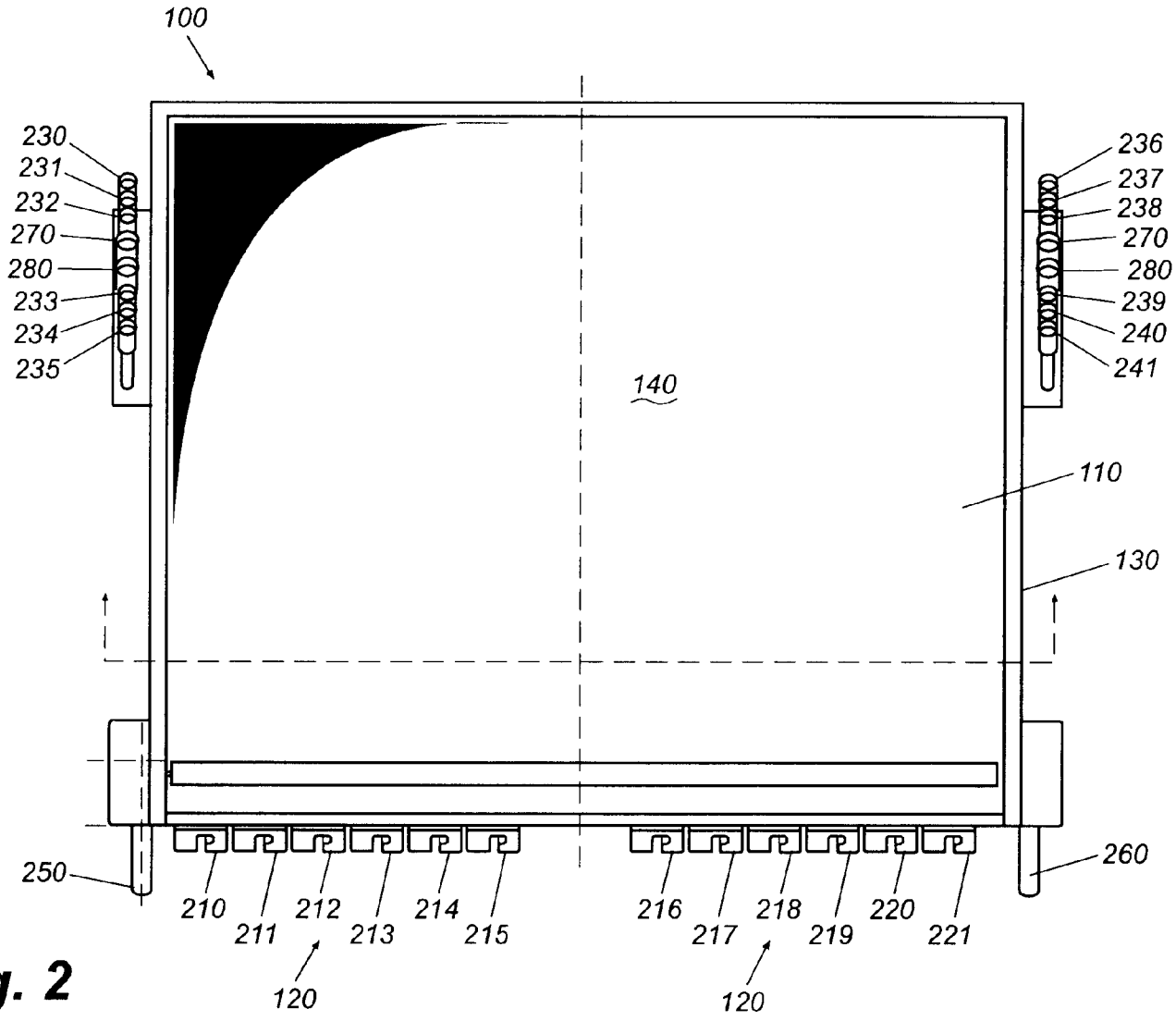
FIG. 2 is a top plan view of the cold plate of the present invention.

The cold plate 100 of FIG. 1 through FIG. 3 has a total of twelve (12) coiling coils 180, specifically a syrup cooling coil 190–201. Each syrup cooling coil 190–201 has an accompanying inlet fitting 210–221 and an accompanying outlet fitting 230–241 in communication therewith. Syrup runs through the inlet fittings 210–221, through the syrup coiling coils 190–201 for heat transfer with the casing 110, and out through the outlet fittings 230–241. A different type or flavor of syrup can be used with each coiling coil 180. Any number or configuration of coiling coils 180 may be used.

The cold plate 100 may include a plain water inlet fitting 250. This fitting 250 is for plain water that runs through the cold plate 100 without going through the carbonator unit. The cold plate 100 further may have a soda water inlet fitting 260. This fitting 260 is for plain water that will travel through the carbonator unit. The cold plate 100 may also have a pair of plain water outlet fittings 270 and soda water outlet fittings 280 on each side of the cold plate 100. Finally, the cold plate 100 may have a carbonator unit outlet fitting 290 and a carbonator unit inlet fitting 300 so as to run plain water through the carbonator unit and produce soda water. The plain water either travels directly through the cold plate 100 via the plain water inlet fitting 250 and the plain water outlet fittings 270 or through the soda water inlet fitting 260, to the carbonator unit through the carbonator unit outlet fitting 290 and the carbonator unit inlet fitting 300, and out through the soda water outlet fittings 280. The pathways the water may take through the cold plate 100 are varied and generally known to those skilled in the art. Any number of different water pathways or configurations may be used depending upon the desired use of the beverage dispenser as a whole.

Figure 4:
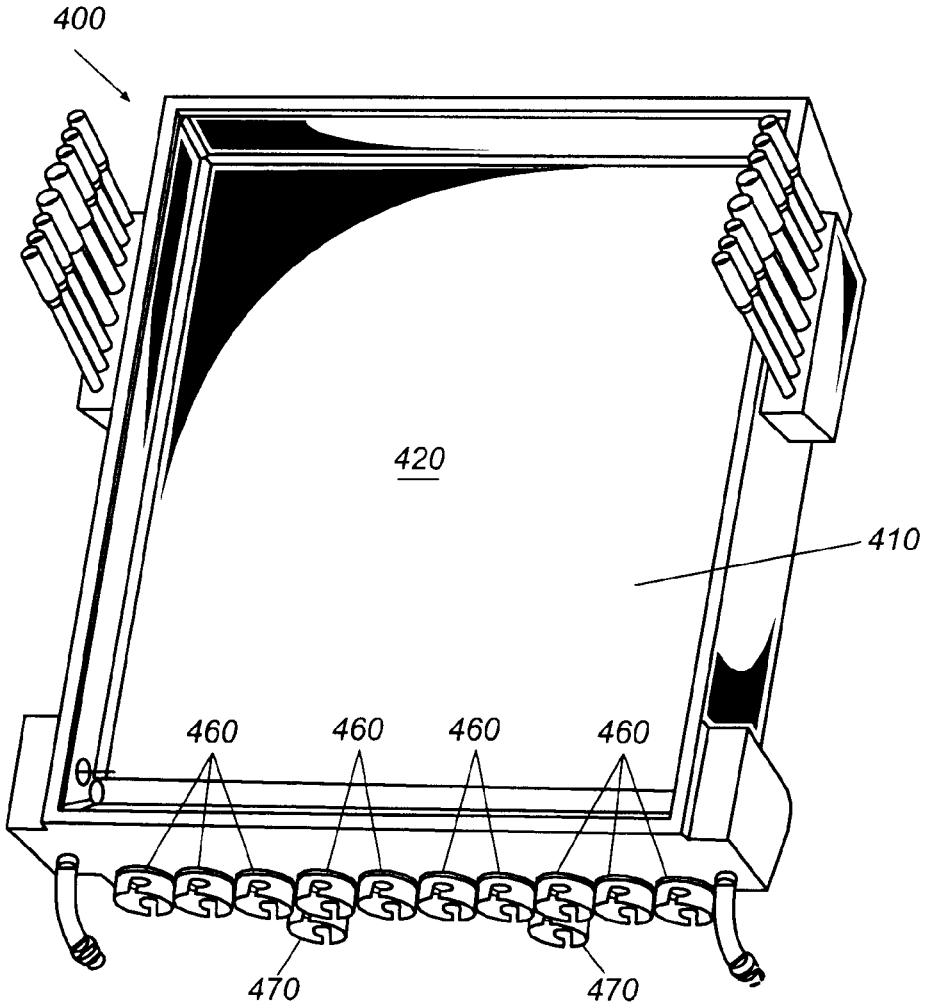
FIG. 4 is a perspective view of an alternative cold plate of the present invention.
Figure 5:
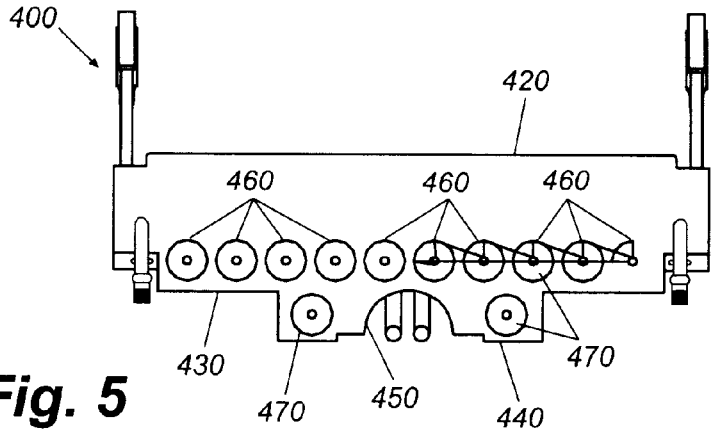
FIG. 5 is a side plan view of the alternative cold plate of FIG. 4.

FIGS. 4 and 5 show an alternative embodiment of the present invention, a cold plate 400. In this embodiment, the cold plate 400 has a casting 410 with a substantially flat top surface 420 for direct physical contact with the ice of the ice chest. The cold plate 400 also has a bottom surface 430. The bottom surface 430 has a raised central portion 440 with a concave portion 450 positioned therein. The concave portion 450 may be similar in shape to the concave middle portion 160 of the cold plate 100 described above. The casing 410 may have a number of upper sleeves 460 positioned adjacent to the upper surface 420 and a number of lower sleeves 470 positioned equally on either side of the concave portion 450 of the raised central portion 440. In this embodiment, a total of ten (10) upper sleeves 460 and two (2) lower sleeves 470 are used. Any number of sleeves 460, 470, however, may be used depending upon the desired use of the beverage dispenser.

This embodiment of the present invention thus provides for a cold plate 400 that may have a top surface 420 with somewhat smaller dimensions than the cold plate 100 described above. This reduced horizontal size is made possible by splitting the sleeves between the upper sleeves 460 and the lower sleeves 470 for a somewhat thicker casting 410. In other words, the cold plate 400 of this embodiment may have a somewhat smaller horizontal dimensions with a somewhat larger vertical profile in terms of relative positions.

Figure 6:
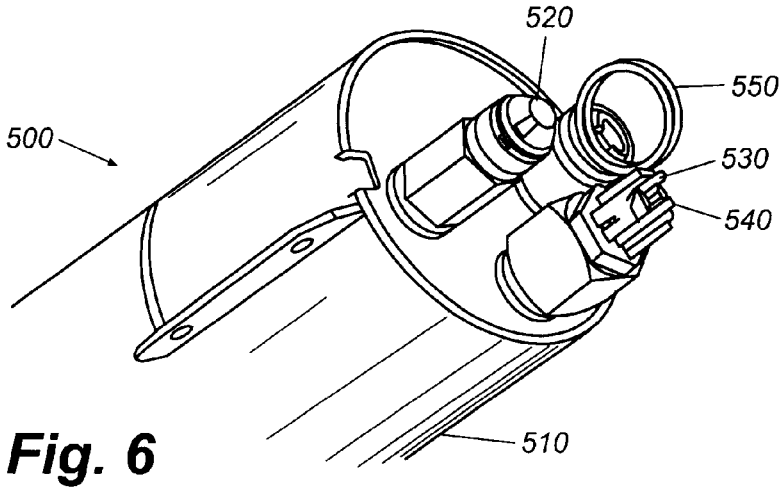
FIG. 6 is a perspective view of a carbonator unit of the present invention.

FIG. 6 shows a conventional carbonator unit 500. The carbonator unit 500 includes an outer shell 500. The outer shell 510 is preferably made from stainless steel or other types of substantially non-corrosive metals with good heat transfer characteristics. The carbonator unit 500 need only be shaped for intimate contact with the concave middle portion 160 of the old plate 100. The carbonator unit 500 also may include a carbon dioxide port 520, a water inlet 530, and a soda water outlet 540. The carbonator unit 500 also may include a pressure release valve 550. The carbonator unit 500 and its internal components may be of conventional design. The carbonator unit 500 mixes the incoming plain water and the carbon dioxide gas to produce soda water as is known in the art. Alternatively, the carbonator unit disclosed in commonly owned U.S. patent application entitled "Modular Dispenser Components", filed simultaneously herewith, also may be used herein. This application is incorporated herein by reference.

Figure 7:
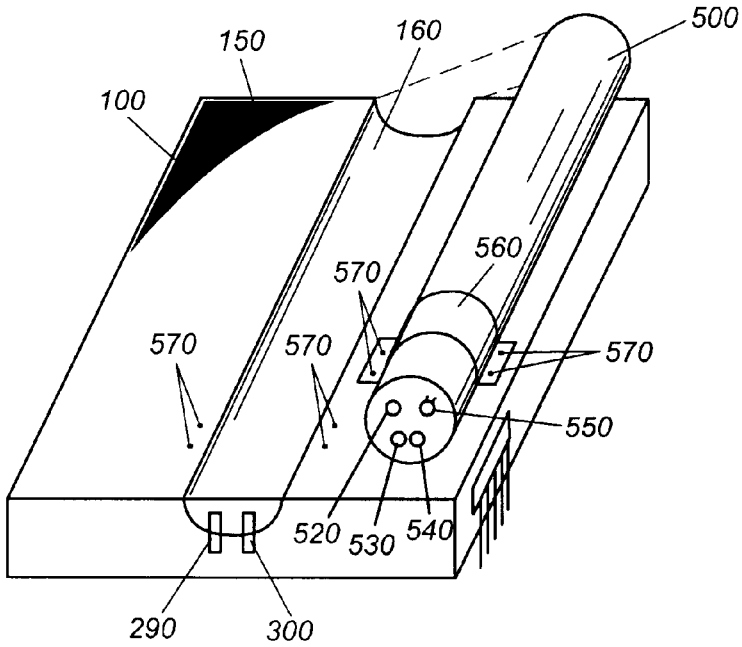
FIG. 7 is a perspective view of a carbonator unit of the present invention as installed within the cold plate of the present invention.

FIG. 7 shows the combination of the cold plate 100 with the carbonator unit 500. The carbonator unit 500 is positioned directly within the concave middle portion 160 of the cold plate 100 for intimate contact therewith. The carbonator unit 500 may be attached to the lower surface 160 of the casing 110 by a frame or a bracket 560. The bracket 560 may be of conventional design. The bracket 560 and the lower surface 160 of the casting 110 may have bolt holes 570 therein such that the carbonator 500 may be fixedly attached to the casting 110 by bolts, screws, or other conventional types of fastening means. The water inlet 530 and the soda water outlet 540 of the carbonator 500 are connected to the carbonator unit outlet fitting 290 and the carbonator unit inlet fitting 300 respectively for fluid flow therethrough. The carbonator unit 500 and the cold plate 100 also may be surrounded by insulation for increased heat transfer therein.

Figure 8:
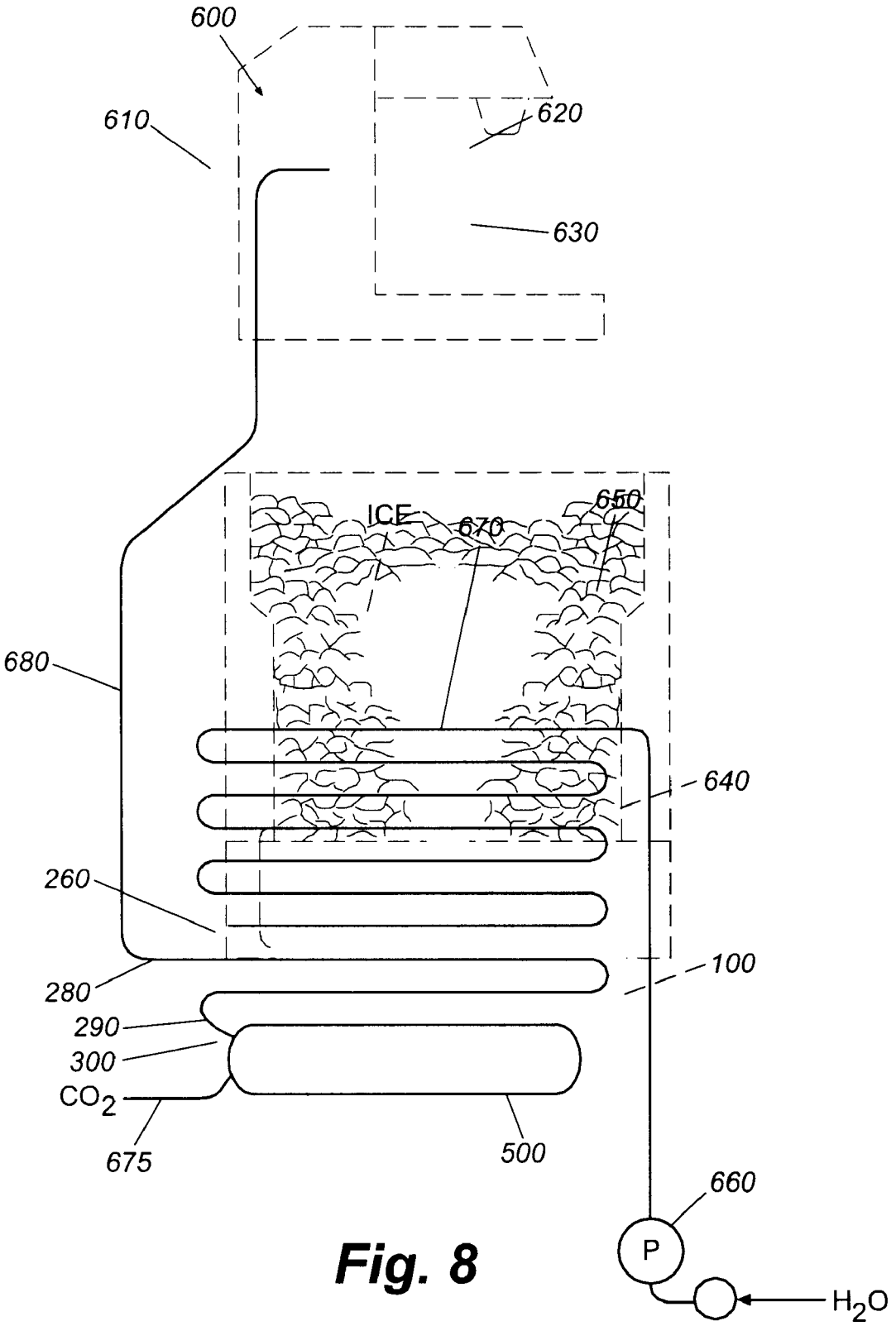
FIG. 8 is a schematic view of the cold plate and the carbonator of the present invention in the context of a beverage dispenser.

FIG. 8 shows a beverage dispenser 600 for use with the present invention. The beverage dispenser 600 may be largely of conventional design. The beverage dispenser 600 includes a tower 610 with a dispensing valve 620 and a dispensing nozzle 630. The beverage dispenser 600 may further include a cabinet 640 with an ice chest 650 positioned therein. The cold plate 100 with the carbonator unit 500 positioned within the concave middle portion 160 of the lower surface 150 is located directly underneath the ice chest 650.

As is shown, plain water may travel from an inlet pump 660 to a pre-chill coil 670 positioned in or adjacent to the ice chest 650. The pre-chill coil 670 may be part of the casing 100. The plain water then continues to the soda water inlet fitting 260, to the carbonator unit 500 through the carbonator unit outlet fitting 290 and the carbonator unit inlet fitting 300, and out through the soda water outlet fittings 280. Carbon dioxide gas is introduced into the carbonator unit 500 via a carbon dioxide line 675. The water therefore is chilled both within the cold plate 100 and within the carbonator unit 500. The soda water then travels though a tower line 680 to the dispensing valve 620 and the dispensing nozzle 630. The soda water is mixed with syrup as is known to those skilled in the art so as to provide a beverage such as a carbonated soft drink or the like.

Approximately thirty (30) to fifty percent (50%) or more of the outer shell 510 of the carbonator unit 500 therefore may be in direct physical contact with the cold plate 100. his direct contact provides for significantly increased cooling of the carbonator unit 500 and the water flowing therein. Carbonation performance also will improve over known ambient-type carbonators because the carbon dioxide will dissolve into a water solution at much higher volumes at lower water temperatures. The chilled carbonator 500 therefore maintains the temperature of the pre-chilled water for increased carbonation volumes. In fact, the carbonation volume of the carbonator 500 may be at least about two (2) to about five (5) volumes or more greater than the current ambient carbonation system of about 3.5 volumes. The beverage dispenser 600 as a whole therefore provides efficient cooling and carbonation to the fluids therein.

It should be understood that the foregoing relates only to the preferred embodiments of the present invention and that numerous changes may be made herein without departing from the spirit and scope of the invention as defined by the following appended claims.

We claim:

1. A cold plate for use with a beverage dispenser, said beverage dispenser having an ice chest and a carbonator unit, said cold plate positioned beneath said ice chest, said cold plate comprising:

a first surface in contact with said ice chest; and a second surface;

said second surface comprising a concave middle portion such that said carbonator unit is positioned within said concave middle portion for contact therewith.

2. The cold plate of claim 1, further comprising a casting with a plurality of sleeves positioned therein.

3. The cold plate of claim 2, wherein said casting comprises aluminum.

4. The cold plate of claim 2, wherein said sleeves comprise stainless steel.

5. The cold plate of claim 2, wherein said sleeves comprise cooling coils.

6. The cold plate of claim 1, further comprising a soda water inlet fitting.

7. The cold plate of claim 1, further comprising a soda water outlet fitting.

8. The cold plate of claim 1, further comprising a carbonator unit outlet fitting in communication with said carbonator unit.

9. The cold plate of claim 8, further comprising a carbonator unit inlet fitting in communication with said carbonator unit.

10. The cold plate of claim 1, wherein said second surface further comprises a raised central portion.

11. The cold plate of claim 10, wherein said raised central portion comprises said concave middle portion therein.

12. The cold plate of claim 11, wherein said first surface comprises a plurality of upper sleeves positioned adjacent thereto and wherein said second surface comprises one or more lower sleeves positioned on either side of said concave middle portion within said raised central portion.

13. A beverage dispenser with an ice chest, comprising:

a carbonator unit; and a cold plate;

said cold plate comprising a first surface in contact with said ice chest; and a second surface;

said second surface comprising a concave middle portion such that said carbonator unit is positioned within said concave middle portion for contact therewith.

14. The beverage dispenser of claim 13, wherein said cold plate comprises a carbonator unit inlet fitting and a carbonator unit outlet fitting.

15. The beverage dispenser of claim 14, wherein said carbonator unit comprises a water inlet in communication with said carbonator unit outlet fitting and a soda water outlet in communication with said carbonator unit outlet fitting.

16. The beverage dispenser of claim 13, wherein said carbonator unit comprises stainless steel.

17. The beverage dispenser of claim 13, wherein said carbonator unit is fixedly attached to said cold plate.

18. The beverage dispenser of claim 13, wherein said carbonator unit comprises an outer shell.

19. The beverage dispenser of claim 18, wherein approximately thirty (30) to fifty percent (50%) of said outer shell of said carbonator unit comprises contact with said cold plate.

20. The beverage dispenser of claim 13, wherein a water stream receives about 4.5 to about 8.5 volumes of carbon dioxide gas when traveling through said carbonator unit.

21. A beverage dispenser with an ice chest, comprising:

a carbonator unit; and a cold plate;

said cold plate comprising a first surface in contact with said ice chest; and a second surface;

said second surface comprising a concave middle portion such that said carbonator unit is fixedly attached within said concave middle portion for intimate contact therewith such that approximately thirty (30) to fifty percent (50%) of said carbonator unit comprises contact with said cold plate.

* * * * *